US005950260A

United States Patent [19]

Dees

[11] Patent Number: 5,950,260

[45] Date of Patent: Sep. 14, 1999

[54] PLEATED UNITARY WORK MAT WITH HEADREST

[76] Inventor: Kent L. Dees, 8385 Lake Ben Ave., San Diego, Calif. 92119

[21] Appl. No.: 09/054,931

[22] Filed: Apr. 3, 1998

Related U.S. Application Data

[63] Continuation of application No. 08/803,888, Feb. 21, 1997.

[51] Int. Cl.[6] ..... A47G 9/06

[52] U.S. Cl. ..... 5/420; 5/417; 5/419; 5/722; 5/656

[58] Field of Search ..... 5/640, 627, 417, 5/419, 420, 722, 656; 280/32.5

[56] References Cited

U.S. PATENT DOCUMENTS

| | | | |
|---|---|---|---|
| 1,104,398 | 7/1914 | Zimmerman | 280/32.6 |
| 1,356,593 | 10/1920 | Bettiker | 5/420 |
| 1,764,756 | 6/1930 | Slee . | |
| 2,038,335 | 4/1936 | Aronow | 5/420 |
| 2,551,976 | 5/1951 | Smith | 5/417 |
| 3,228,491 | 1/1966 | Gatsos | 184/106 |
| 3,284,819 | 11/1966 | Nissen | 5/420 |
| 3,323,151 | 6/1967 | Lernan | 5/420 |
| 3,555,581 | 1/1971 | Friant | 5/722 |
| 3,636,576 | 1/1972 | Nissen | 5/420 |
| 3,834,527 | 9/1974 | Howe | 206/494 |
| 3,984,116 | 10/1976 | Bowers | 280/32.6 |
| 4,190,918 | 3/1980 | Harvell | 5/417 |
| 4,194,601 | 3/1980 | Yellin | 5/417 |
| 4,370,767 | 2/1983 | Fraser | 5/417 |
| 4,603,444 | 8/1986 | Suits | 5/465 |
| 4,682,447 | 7/1987 | Osborn | 5/417 |
| 4,766,626 | 8/1988 | Green | 5/420 |
| 4,800,602 | 1/1989 | Luery | 5/417 |
| 4,801,005 | 1/1989 | Hahn et al. | 141/98 |
| 4,815,155 | 3/1989 | Sommers | 5/417 |
| 4,824,411 | 4/1989 | McClanahan | 5/465 |
| 4,868,940 | 9/1989 | Masadi | 5/417 |
| 4,905,330 | 3/1990 | Jacobs | 5/420 |
| 4,908,887 | 3/1990 | Shaw, Jr. | 5/419 |
| 4,926,512 | 5/1990 | Coyle | 5/417 |
| 4,967,428 | 11/1990 | Browder | 5/419 |
| 4,987,625 | 1/1991 | Edelson | 5/420 |
| 5,020,854 | 6/1991 | Powell | 5/419 |
| 5,066,001 | 11/1991 | Wilkinson | 5/465 |
| 5,195,763 | 3/1993 | Scott et al. | 280/32.6 |
| 5,297,809 | 3/1994 | Chen | 280/32.6 |
| 5,394,575 | 3/1995 | Wolter et al. | 5/419 |
| 5,419,945 | 5/1995 | Lopez | 428/178 |

*Primary Examiner*—Michael F. Trettel
*Assistant Examiner*—Fredrick Conley
*Attorney, Agent, or Firm*—John L. Rogitz

[57] ABSTRACT

A cardboard work mat has a pleated configuration, wherein the mat is folded in pleats for storage, and an unfolded configuration, wherein the mat defines a surface area sufficiently large for supporting a mechanic beneath a vehicle. A headrest is formed on one end of the mat by folding over the two or three end-most pleats together and then bonding them together. In an alternate embodiment, the mat is a flexible plastic sheet which has a rolled configuration for storage and an unrolled configuration for supporting a mechanic on the sheet. A headrest is molded or attached to one end of the sheet. Yet again, the pad can be a pleated corrugated plastic pad having a head rest removably attached thereto by hook and eye fasteners.

3 Claims, 3 Drawing Sheets

Fig. 1A
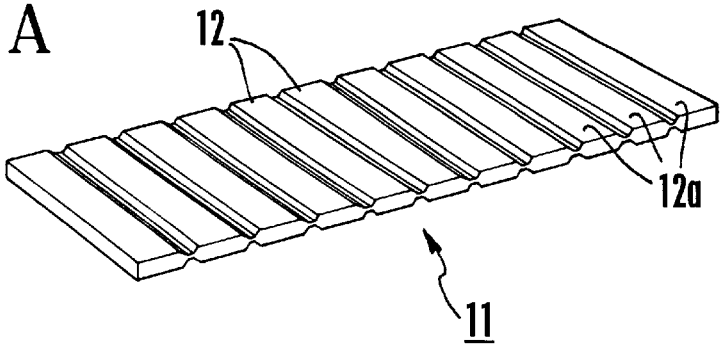
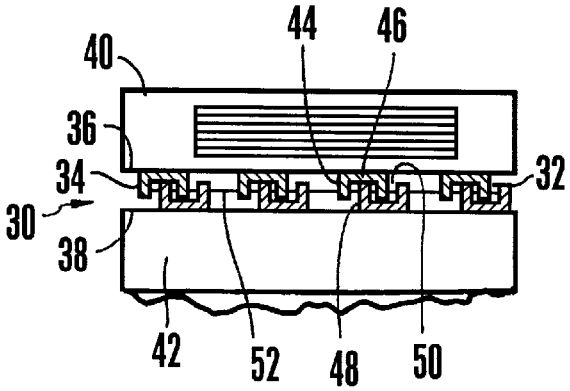
Fig. 4
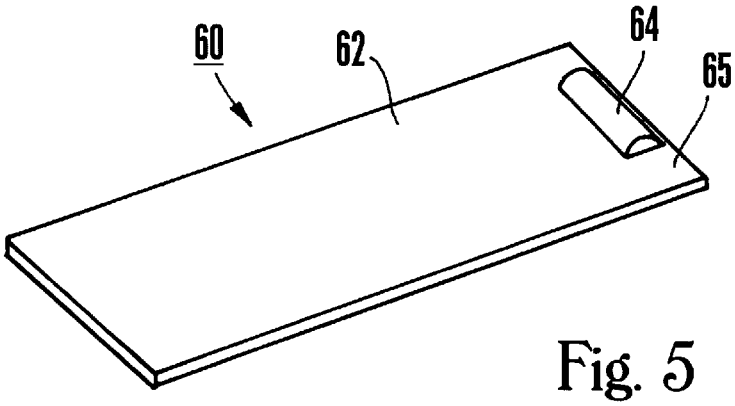
Fig. 5
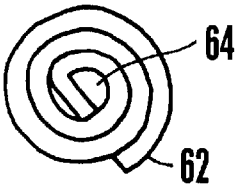
Fig. 6

PLEATED UNITARY WORK MAT WITH HEADREST

RELATED APPLICATIONS

This application is a continuing application of and claims priority from my co-pending U.S. patent application Ser. No. 08/803,888, filed Feb. 21, 1997, for an invention entitled "PLEATED WORK MAT WITH FOLDED-OVER HEADREST", which in turn claims priority from 08/550,250, filed Oct. 6, 1995 for an invention entitled "PLEATED WORK MAT WITH INTEGRAL HEADREST", now U.S. Pat. No 5,669,089.

FIELD OF THE INVENTION

The present invention relates generally to mechanic's accessories, and more particularly to support structures on which mechanics can lay supine beneath a vehicle or otherwise lay or kneel on while performing maintenance.

BACKGROUND

Automotive creepers have been provided for supporting a mechanic in a supine position beneath a vehicle while the mechanic performs maintenance on the vehicle. During maintenance, the platform of a typical creeper is not disposed on the ground, but is supported by wheels or casters, to facilitate positioning the creeper in the desired location beneath the vehicle, as disclosed in, e.g., U.S. Pat. No. 5,195,763 to Scott et al. Consequently, the platform of most creepers must be rigid, to impart sufficient strength to the platform for supporting the mechanic above the ground.

Accordingly, while effective for their intended purpose, creepers require the use of comparatively large, rigid platforms which can be relatively expensive to make and which are cumbersome, heavy, and bulky to store. Further, the rigidity of many creeper platforms tends to make them uncomfortable to lay on for prolonged periods. Still further, owing to their relatively high expense, most creepers are generally unsuitable for disposable use. The present invention recognizes, however, that an inexpensive, effective work mat can be provided which is both comfortable, lightweight, and easy to store, and which can be made of inexpensive recyclable materials.

It is therefore an object of the present invention to provide a work mat which is effective and comfortable, and more particularly which includes means for supporting a person's head while laying supine beneath a vehicle. Another object of the present invention is to provide a mechanic's mat which can be easily stored in a compact location. Still another object of the present invention is to provide a mechanic's mat which is easy to use and cost-effective to manufacture.

SUMMARY OF THE INVENTION

A work mat includes a pad that is manually movable between an unfolded configuration, wherein the pad is substantially flat such that a person can lie supine on the pad beneath a vehicle, and a pleated configuration, wherein the pad is pleated to facilitate storing the pad. A head rest is attached to the pad at one end thereof to support the head of a person when the person lies supine on the pad.

Preferably, the pad includes a plurality of panels and a plurality of hinge joints. In accordance with the present invention, a respective hinge joint is positioned between adjacent panels to facilitate folding the mat into the pleated configuration. In the presently preferred embodiment, the pad is made of cardboard, and each hinge joint is a living joint that is established by score lines formed between adjacent panels. Alternatively, the pad can be made of scribed plastic. As envisioned by the preferred embodiment, the head rest is established by at least two panels that are bonded flushly together at one end of the pad.

In an alternate embodiment, the hinge joints are mechanical joints which include interlocking U-shaped members. In yet another alternate embodiment, the pad is a plastic flexible pad which is movable between an unrolled configuration, wherein the pad is substantially flat, and a rolled configuration, wherein the pad is rolled to facilitate storing the pad.

In another aspect of the present invention, a cardboard mechanic's mat for supporting a person beneath a vehicle is disclosed. As discussed in further detail below, the mat includes an elongated, generally parallelepiped-shaped cardboard pad that is transversely scored to establish a plurality of panels. Consequently, each panel is hingedly engaged with its contiguous panels such that the pad is movable between an unfolded configuration, wherein the panels are substantially co-planar with each other, and a pleated configuration, wherein the panels are pleatedly folded against each other. A head rest is positioned on one end of the pad, and the head rest is established by bonding at least two panels flush together.

In yet another aspect of the present invention, an elongated cardboard mechanic's pad has transverse score lines formed thereon and spaced apart about four inches to eight inches. Consequently, the pad can be easily pleated for storage. Also, the pad has a head rest for supporting the head of a person lying supine on the pad when the pad is not pleated.

In still another aspect, a work mat includes a pad that in turn includes a plurality of panels. The panels are manually movable between an unfolded configuration, wherein the pad is substantially flat such that a person can lie supine on the pad beneath a vehicle, and a pleated configuration, wherein the pad is pleated to facilitate storing the pad. A head rest is engaged with the pad at one end thereof to support the head of a person when the person lies supine thereon. In one embodiment, the head rest is established by folding over a plurality of panels against each other.

In an alternate embodiment, a work mat includes a pad including a plurality of panels manually movable between an unfolded configuration, wherein the pad is substantially flat such that a person can lie supine on the pad beneath a vehicle, and a pleated configuration, wherein the pad is pleated to facilitate storing the pad. A foam pillow head rest is attached to one of the panels of the pad at one end of the pad to support the head of a person when the person lies supine thereon. Preferably, the mat defines a side edge, the mat further includes a tab protruding outwardly from the side edge and a strap attached to the mat for holding the mat in the pleated configuration. A handhold aperture is formed in the pad opposite the strap. In another aspect of this embodiment, a single-piece pleated mechanic's mat for supporting a person beneath a vehicle includes an elongated, generally parallelepiped-shaped pad transversely scored to establish a plurality of panels hingedly engaged such that the pad is movable between an unfolded configuration, wherein the panels are substantially co-planar with each other, and a pleated configuration, wherein the panels are pleatedly folded against each other. A head rest is attached to one of the panels of the pad, with the head rest being established by a resilient material.

The details of the present invention, both as to its structure and operation, can best be understood in reference to the accompanying drawings, in which like reference numerals refer to like parts, and in which:

BRIEF DESCRIPTION OF THE DRAWINGS

FIG. 1A is a perspective view of the work mat prior to establishing the head rest;

FIG. 4 is a top plan view of an alternate embodiment of the pleated mat, showing an interlocking joint structure between panels, with portions broken away;

FIG. 5 is a perspective view of still another alternate embodiment of the present invention, showing a rollable plastic mat in the unrolled configuration;

FIG. 6 is a side plan view of the mat shown in FIG. 5, in the rolled configuration;

DETAILED DESCRIPTION OF THE PREFERRED EMBODIMENT

Figure 1:
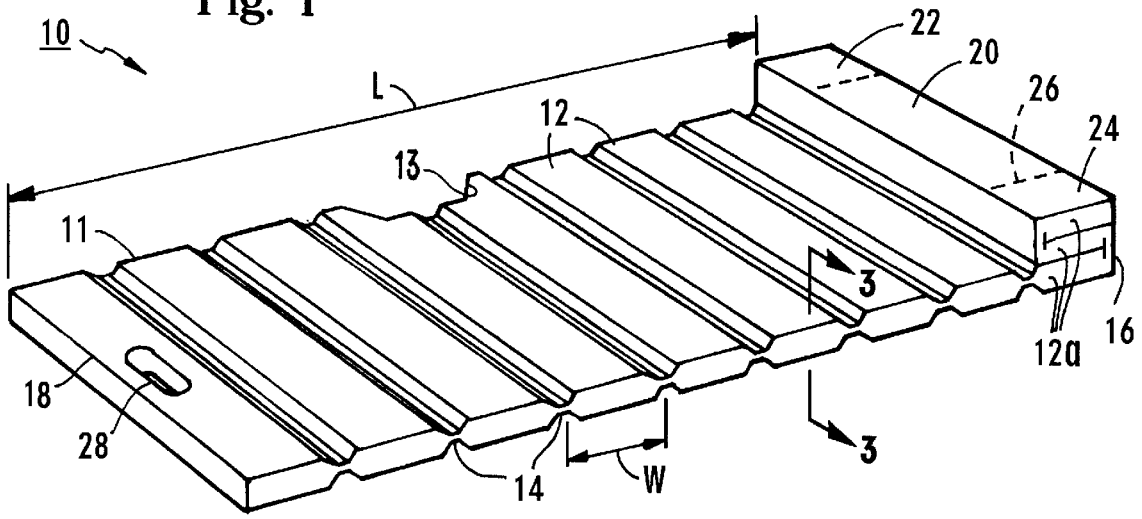
FIG. 1 is a perspective view of the pleated work mat of the present invention, showing the mat in the unfolded configuration.

Referring initially to FIG. 1, a work mat is shown, generally designated 10, in an unfolded configuration. It will readily be appreciated in reference to FIG. 1 that a person (not shown) can position the mat 10 beneath a vehicle (not shown) and then lie supine on the mat 10 to facilitate maintenance on the vehicle.

In accordance with the present invention, the mat 10 includes a body pad 11 made of an inexpensive material, preferably cardboard, which can be formed in the elongated, parallelepiped-shaped configuration shown by means well-known in the art. Alternatively, the pad 11 can be made of plastic, such as polypropylene or vinyl.

In accordance with the present invention, the pad 11 includes a plurality of panels 12 which are substantially co-planar with each other in the unfolded configuration shown in FIG. 1 to thereby render the pad 11 substantially flat throughout its length "L". Preferably, each panel 12 defines a width "W" of about two to eight inches (2"–8"), and more preferably about six inches (6"). As recognized by the present invention, the panels 12 can accordingly be relatively narrow despite being made of cardboard, because the panels 12 are positioned flush against the ground in the unfolded configuration when supporting a person, and consequently need not be sufficiently strong to support a person sitting against the panels 12 in an upright sitting position. If desired, a generally trapezoidal-shaped mirror clearance aperture 13 can be formed in the pad 11 to avoid interfering with the rear view mirror of a vehicle (not shown) when the pad 11 is positioned against the inside surface of the windshield to screen the dashboard when the vehicle is unoccupied.

A respective one of a plurality of living hinge joints 14 is formed between adjacent panels 12 by means well-known in the art, e.g., by transversely scoring the pad 11 of the mat 10 to establish the joints 14 when the pad is made of cardboard, or by scribing a pad that is made of plastic. It is to be understood that a panel 12 can be hingedly folded relative to one of its immediately adjacent panels 12 about the joint 14 which is positioned therebetween. Thus, as intended by the present invention, "scored" means weakening the cardboard pad 11 along the hinge joints 14 by means well-known in the art to permit folding the pad 11 along the hinge joints 14.

As shown in FIG. 1, the mat 10 defines a head end 16 and a foot end 18. In brief cross-reference to FIGS. 1 and 1A, the three panels 12*a* that are adjacent the head end 16 are folded in pleats against each other and then bonded or stapled in the configuration shown to permanently establish a padded head rest 20 which is elevated relative to the panels 12 which are not part of the head rest 20. By "permanently establish" is meant that panels 12*a* which establish the head rest 20 cannot easily be separated from each other. If desired, ends 22, 24 of the head rest 20 can be removed from the mat 10 as indicated along the dotted lines 26 in FIG. 1 as by, e.g., chopping the ends 22, 24 by means well-known in the art.

Alternatively, the head rest 20 can be made separately from the panels 12, and then bonded to the panels 12. For example, the head rest 20 can be made of cardboard or of an air-inflatable plastic material and then bonded to the panels 12. In either case, a hand opening 28 preferably is cut into the mat 10 near the foot end 18 to facilitate manually carrying the mat 10, or hanging the mat 10 on a wall.

Figure 2:
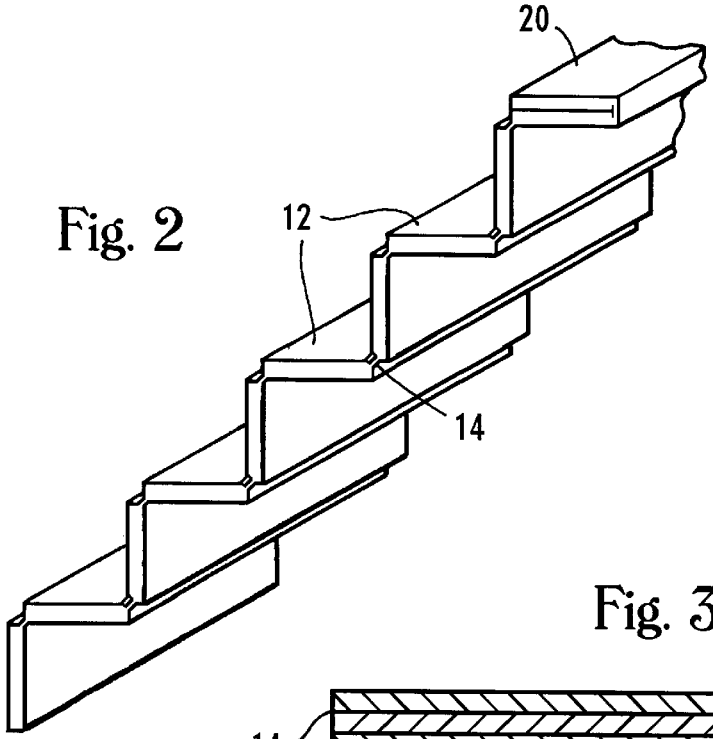
FIG. 2 is a perspective view of the mat intermediate the unfolded configuration and pleated configuration, with portions broken away.
Figure 3:
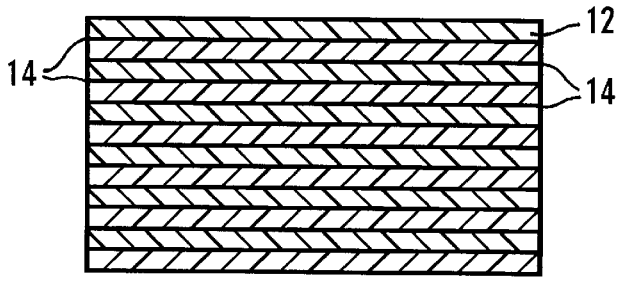
FIG. 3 is a cross-sectional view of the mat, as would be seen along the line 3—3 in FIG. 1 in the pleated configuration.

FIGS. 2 and 3 show that the mat 10 can be manually moved to a pleated configuration by hingedly pivoting the panels 12 relative to each other in a double fold (i.e., pleated) pattern about the joints 14. FIG. 3 best shows that in the fully pleated configuration, the panels 12 are folded flush against each other in a compact configuration to facilitate storage of the mat 10 in a relatively small space.

FIG. 4 shows a work mat, generally designated 30, which is in all essential respects identical to the mat 10 shown in FIGS. 1–3, except that each living hinge 14 shown in FIGS. 1–3 has been replaced by a respective mechanical hinge 32. Specifically, each mechanical hinge 32 includes a plurality of U-shaped members 34, each of which is bonded or otherwise attached to a first or second edge 36, 38 of adjacent first and second panels 40, 42 and interlocked with an associated opposed U-shaped member 34.

More specifically, each U-shaped member 34 on the first edge 36 includes two first arms 44 which establish a first trough 46 therebetween, while each U-shaped member 34 on the second edge 38 includes two second arms 48 which establish a second trough 50 therebetween. One of the first arms 44 of each U-shaped member 34 on the first edge 36 is disposed in a second trough 50 of a U-shaped member 34 on the second edge 38. Likewise, one of the second arms 48 of each U-shaped member 34 on the second edge 38 is disposed in the first trough 46 of a U-shaped member 34 on the first edge 36. An elongated cylindrical pin 52 is inserted through the arms 44, 48 of the U-shaped members 34 to pivotably hold the members 34 in the hinged connection shown.

FIGS. 5 and 6 show a mat, generally designated 60, which is made of a single parallelepiped-shaped pad 62 of flexible plastic material, e.g., Teflon® vinyl. As shown, the mat 60 includes a padded foam or plastic inflatable resilient head rest 64 that is formed integrally with or bonded to the pad 62 near a head end 65 of the pad 62. As intended by the present invention, the mat 60 can assume a flat unrolled configuration (FIG. 5) for supporting a person on the pad 62 beneath a vehicle. As further intended by the present invention, the mat 60 can assume a rolled configuration (FIG. 6) to facilitate storing the mat 60 in a relatively small space.

Figure 7:
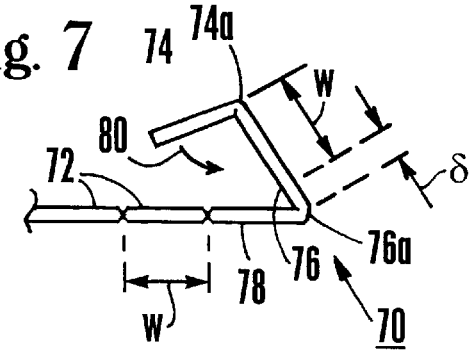
FIG. 7 is a side view of an alternate embodiment in which the head rest is established by folding over three end panels, with portions cut away for clarity.

Now referring to FIG. 7, a mat, generally designated 70, includes a plurality of mat panels 72 and at least three first, second, and third head rest panels 74, 76, 78. As shown, the mat 70 is in all essential respects identical in configuration to the mat 10 shown in FIG. 1, except that the head rest of the mat 70 is established by folding over the head rest panels 74, 76, 78 on themselves, instead of pleatedly folding the head rest panels 74, 76, 78.

Stated differently, the first head rest panel 74 is folded from right to left along a hinge joint 74*a* to position the first head rest panel 74 flushly against the second head rest panel 76, as indicated by the arrow 80. Then, the flush first and second panels 74, 76 are folded from right to left along a hinge joint 76*a* to position the first head rest panel 74 flushly against the third head rest panel 78. Accordingly, as used herein "folding over" means establishing a head rest by folding head rest panels along two or more hinge joints in a single direction, e.g., left-to-right, then left-to-right, vice in a pleated fold, e.g., left-to-right, then right-to-left.

As shown in FIG. 7, each mat panel 72 and the first and third head rest panels 74, 78 have widths "w". On the other hand, to accommodate folding the relatively thick combined first and second head rest panels 74, 76 against the third head rest panel 78 along the hinge joint 76*a*, the second head rest panel 76 has a width equal to "w" plus an offset width increment "δ", with "δ" being approximately equal to the thickness of a single panel. It is to be understood that when the head rest of the mat 70 is to be established by more than three head rest panels 74, 76, 78, the second panel 76 will have a thickness equal to "w" plus "δ", the third head rest panel 78 will have a thickness equal to "w" plus "2δ", and so on.

Figure 8:
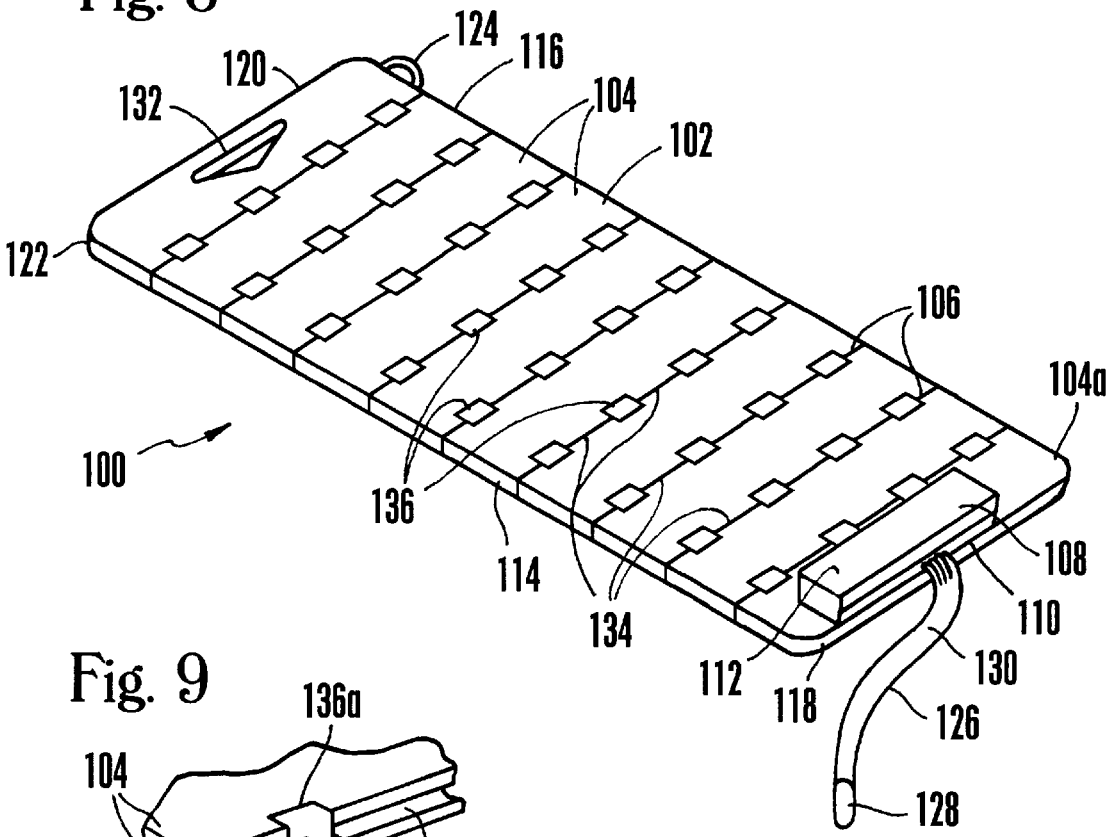
FIG. 8 is a perspective view of yet another pleated mat in the unfolded configuration, with head rest removably attached thereto.

FIG. 8 shows a pleated mat, generally designated 100, which includes a pleated lightweight plastic pad 102 that can be moved between an unfolded configuration shown, wherein the pad is substantially flat such that a person can lie supine on the pad beneath a vehicle, and a pleated configuration, wherein the pad 100 is pleated to facilitate storing the pad 100. Accordingly, like the mats described above, the mat 100 shown in FIG. 8 has a plurality of equally-sized panels 104, with adjacent panels 104 being separated by a respective living hinge 106. Preferably, the pad 102 is made of corrugated plastic such as polypropylene or polyethylene copolymers. Examples of such corrugated plastic are marketed by Kiva Container Corp. of Fullerton, Calif. As shown, the mat 100 is transversely scored with the hinges 106 but is not longitudinally scored, such that only a single plurality of transversely continuous panels 104 (i.e., panels having no longitudinal scoring or folding thereon) is established.

A foam pillow head rest 108 is attached to one of the panels 104 of the pad 100, and more specifically to an end panel 104*a* of the pad. The head rest 108 can be bonded to the end panel 104*a* or more preferably removably held on the end panel 104*a* by hook-and-eye stripping 110 such as is marketed under the trademark Velcro®. If desired, the head rest 108 can be covered by a coating 112 such as a spray-on surface coating or a vinyl sleeve that is shrink-wrapped onto a foam body.

As shown, the mat 100 defines left and right side edges 114, 116 and head and foot ends 118, 120. Desirably, the corners 122 between edges and ends are rounded as shown. A hollow circular tab 124 is glued to one of the side edges 114, 116 and protrudes outwardly therefrom to, e.g., engage a wall hook on which the mat 100 can be hung in the pleated configuration.

If desired, a nylon strap 126 can be attached to the mat 100 at or near the head end 118, and the strap 126 includes a Velcro® hook layer 128 that engages a Velcro® eye layer 130 for holding the mat 100 in the pleated configuration. More specifically, the mat 100 can be moved to the pleated configuration, the strap 126 passed through a handhold aperture 132 that is formed in the mat 100 opposite the strap 126, and then the Velcro® hook layer 128 engaged with the Velcro® eye layer 130 to hold the mat 100 in the pleated configuration.

Figure 9:
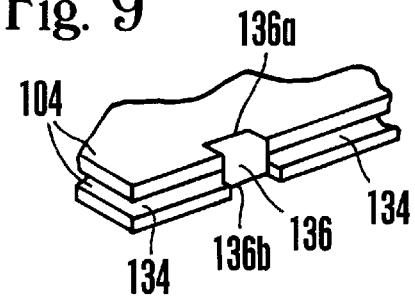
FIG. 9 is a perspective view of the mat shown in FIG. 8 in the pleated configuration, with portions broken away.

In cross-reference to FIGS. 8 and 9, when the pad 102 is made of corrugated plastic each living hinge 106 between adjacent panels 104 includes a respective series of slits 134 that separate the adjacent panels 104, and a series of continuous tabs 136 staggered between the slits 134. Thus, the slits 134 of a particular hinge joint 106 are colinear with each other, and each slit 134 of a hinge joint 106 is separated from at least one adjacent slit 134 in the same hinge joint 106 by at least one continuous tab 136. The slits 134 are cut through the pad 102; thus, adjacent panels 104 are separated from each other along the slits 134.

In contrast, each continuous tab 136 is unitarily formed with the respective adjacent panels 104 as shown in FIG. 9. Also, each continuous tab 136 in turn includes first and second transverse fold lines 136*a*, 136*b* that are respectively formed between the tab 136 and the adjacent panels 104. With this structure the mat 100 is effectively retained in the pleated configuration shown in FIG. 9, with the panels 104 folded flat against each other, without requiring a strap.

While the particular work mat as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

I claim:

1. A single-piece pleated mechanic's mat for supporting a person beneath a vehicle, comprising:

an elongated, generally parallelepiped-shaped pad transversely scored but not longitudinally scored to establish only a single plurality of transversely continuous panels hingedly engaged such that the pad is movable between an unfolded configuration, wherein the panels are substantially co-planar with each other, and a pleated configuration, wherein the panels are pleatedly folded against each other, the pad defining a top surface on which a person can lay and a bottom surface opposed to the top surface, and only a single unitary piece of material therebetween;

a head rest attached to one of the panels of the pad, the head rest being established by a resilient material; and a living hinge joint positioned between adjacent panels to facilitate moving the mat to the pleated configuration, each hinge joint including at least a first slit separated from at least a second slit in the hinge joint by at least one tab unitarily made with the pad such that each hinge joint includes plural slits separated from each other by plural tabs.

2. The mat of claim 1 wherein each tab includes first and second transverse fold lines.

3. The mat of claim 1, wherein the head rest is removably attached to the pad.

* * * * *